United States Patent [19]

Kovar et al.

[11] 4,246,736

[45] Jan. 27, 1981

[54] JOIST BRIDGING MEMBER

[76] Inventors: Paul J. Kovar, 4613 N. 53rd Dr., Phoenix, Ariz. 85031; Marvin D. Southerlan, 2409 E. Yucca, Phoenix, Ariz. 85028

[21] Appl. No.: 25,921

[22] Filed: Apr. 2, 1979

[51] Int. Cl.[3] ..... E04C 3/02

[52] U.S. Cl. ..... 52/696; 52/712

[58] Field of Search ..... 52/696, 712, 317, 695, 52/690, 715

[56] References Cited

U.S. PATENT DOCUMENTS

| | | | |
|---|---|---|---|
| 960,197 | 5/1910 | Priddle | 52/696 |
| 1,027,425 | 5/1912 | Makowski | 52/696 |
| 2,042,370 | 5/1936 | Walker | 52/696 |
| 2,565,875 | 8/1951 | Musacchia | 52/695 |
| 2,964,807 | 12/1960 | Kennedy | 52/696 |

*Primary Examiner*—Price C. Faw, Jr.
*Assistant Examiner*—Carl D. Friedman
*Attorney, Agent, or Firm*—Warren F. B. Lindsley

[57] ABSTRACT

A one-piece cross brace or bridging member for parallel structure beams, such as joists, studs, rafter trusses and the like which spaces and holds them in place relative to each other during assembly, and under normal building load conditions holds them in place longitudinally and prevents or greatly reduces lateral warpage or deflection thereof.

9 Claims, 10 Drawing Figures

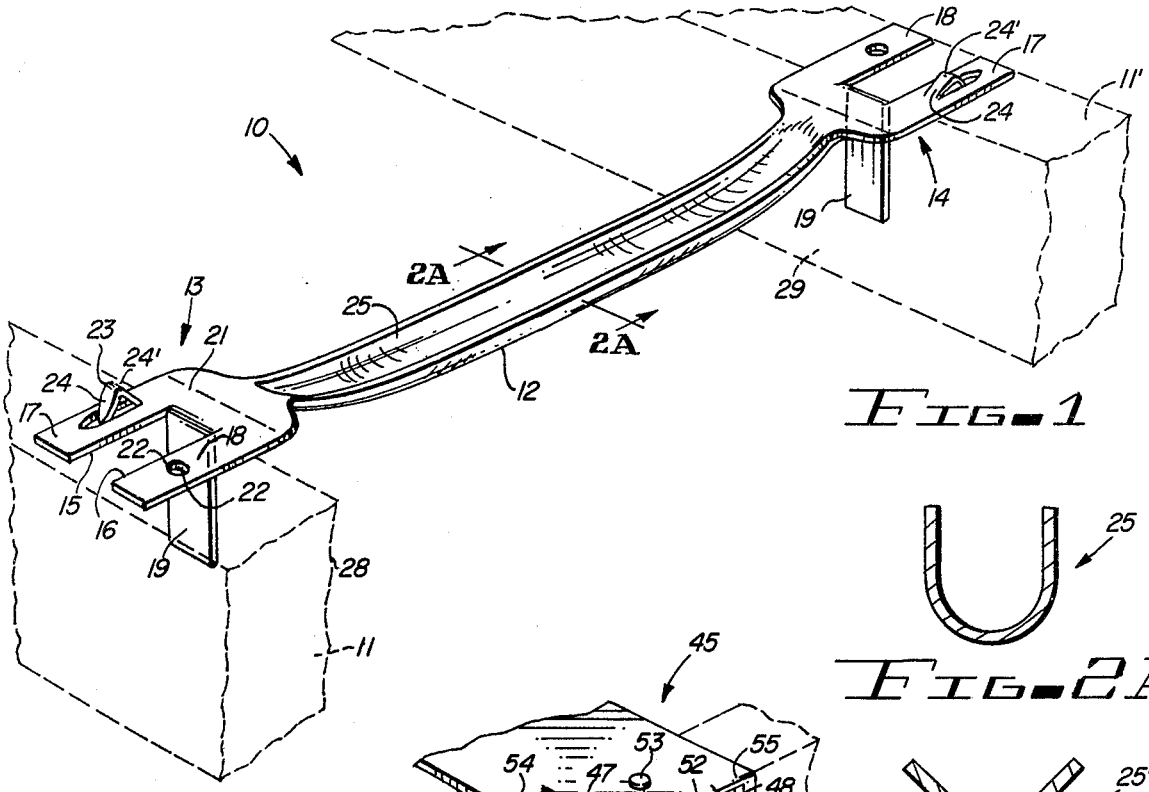
FIG. 1
FIG. 2A
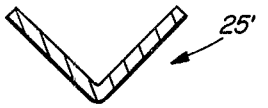
FIG. 2B
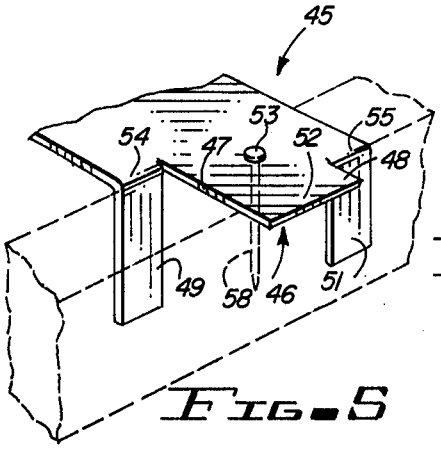
FIG. 5
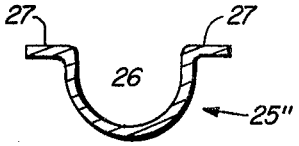
FIG. 2C
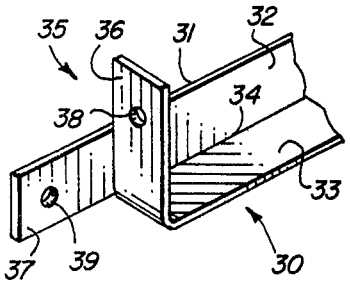
FIG. 4
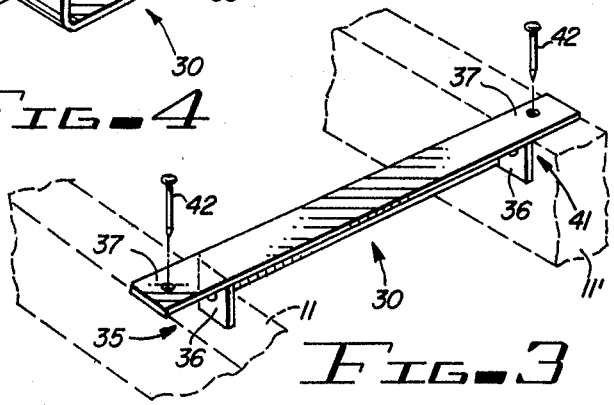
FIG. 3
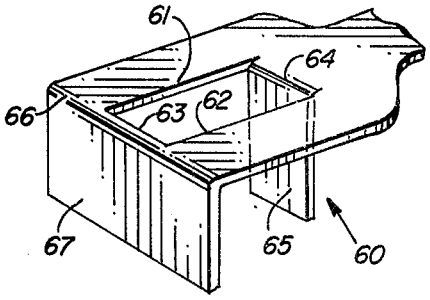
FIG. 6
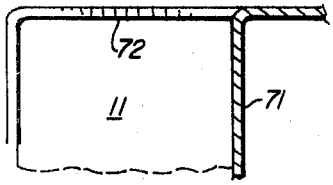
FIG. 8
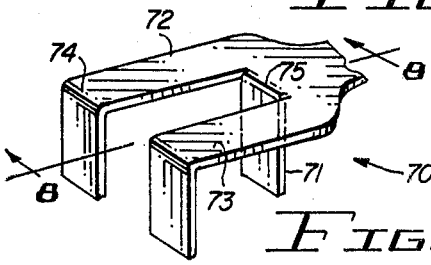
FIG. 7

JOIST BRIDGING MEMBER

DESCRIPTION OF THE PRIOR ART

Building braces have been used in the walls of buildings under construction to maintain the studs and trusses a distance apart and to strengthen the walls and ceiling anchored thereto under normal building loads and warping conditions.

U.S. Pat. No. 1,725,414 discloses a structural bracing member for spaced floor joists comprising a vertical portion arranged to be affixed to a joist and a bracing element extending from the bottom of the vertical portion. The top of the vertical portion is affixed to the end of a cooperating bracing element.

U.S. Pat. No. 1,742,045 discloses a brace bar having portions at one end for individually engaging different faces of the wooden studs against which the end of the bar is disposed.

U.S. Pat. No. 2,455,904 discloses an adjustable bridging member for building structures comprising a pair of brace arms pivotally connected to each other.

U.S. Pat. No. 2,865,059 discloses a horizontal bar connectable at its opposite ends to and extends transversely between adjacent joists. A second bar of inverted V-shape is connected at its apex to the midlength portion of the first bar and has short, horizontal extensions at its ends adapted to be secured to the bottom edges of the joists.

U.S. Pat. No. 2,914,816 discloses a bracing extending diagonally between adjacent joists and a fixed clamp for engaging the bracing elements in thrust relationship to the adjacent joists.

U.S. Pat. No. 4,122,647 discloses a bridging member employing a pair of spaced members interconnected by a cross brace with means extending from one of the spaced members for extending over the exterior edges of a pair of structural members.

As noted from these patents, prior art bridging members are in general relatively complex is structure and expensive to fabricate.

SUMMARY OF THE INVENTION

In accordance with the invention claimed, an improved brace or bridging member is provided for connecting spaced joists, studs, rafter trusses and the like parallel structural beams together.

It is, therefore, one object of this invention to provide an improved brace or bridging member which will aid the carpenter in parallelly arranging structural beams during assembly and will provide improved resistance to twisting under tension and stretching under load.

Another object of this invention is to provide an improved building brace which aligns and holds in place parallelly arranged juxtapositioned structural beams and prevents them from laterally distorting or deflecting.

A further object of this invention is to provide an improved bracing member which when used by the carpenter to position juxtapositioned structure beams also braces them for preventing lateral displacement including warping but does so with a relatively inexpensive bracing structure.

A still further object of this invention is to provide an improved bridging member which self spaces the parallel support members requiring no temporary lay-out or temporary bracing previous to installation.

A still further object of this invention is to provide an improved bridging member employing ears for placement over the tops of adjacent trusses for ease in installation.

A still further object of this invention is to provide such an improved bridging member which is simple in structure and which may be formed from a single piece of material.

It should be noted that throughout the description of the invention floor and ceiling joints, roof rafters, trusses, studding and the like will be included in the term "joists".

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawing in which:

FIG. 1 is a perspective view of a bridging member embodying the invention installed in place between two parallelly arranged structural beams;

FIG. 2A is a cross-sectional view of FIG. 1 taken along the line 2A—2A;

FIG. 2B shows an alternate cross-sectional form for the member of FIG. 1 at line 2A—2A;

FIG. 2C shows another alternate cross-sectional form for the member of FIG. 1 at line 2A—2A;

FIG. 3 is a perspective view of a bridging member in a second embodiment of the invention installed in place between two parallelly arranged beams;

FIG. 4 is a close-up perspective view of one end of the bridging member of FIG. 3;

FIG. 5 is a perspective view of one end of a bridging member embodying the invention in another structural variation;

FIG. 6 is a perspective view of one end of a bridging member embodying the invention in yet another structural variation;

FIG. 7 is a perspective view of a bridging member embodying the invention and comprising a minor variation of the member of FIG. 6; and FIG. 8 is a cross-sectional view of FIG. 7 taken along line 8—8.

DESCRIPTION OF THE PREFERRED EMBODIMENT

Referring more particularly to the drawing by characters of reference, FIGS. 1 and 2A disclose a parallel structural beam one-piece bridging member or cross brace 10. This brace is used for bracing studs, rafters, trusses or joists 11 to hold them together and in place during building when these structural elements receive floor, ceiling and wall boards, the brace maintaining them in place under building loads and stresses.

These braces are located wherever desired along the length of the joists and are usuable to advantage in positioning one beam parallel to an adjacent beam during construction as well as to bridge these beams for proper weight distribution and to prevent the spreading of the joists and warpage thereof under load conditions.

As shown in FIG. 1, the one-piece bridging member 10 comprises a central spanning web or arm 12 with specially-shaped ends 13 and 14. The ends 13 and 14 are identical, and each is shaped to permit its secure fastening to an associated beam 11.

In the orientation shown in FIG. 1, beams 11, 11′ are horizontal as in the case of ceiling joists and member 10 extends at a right angle from one beam 11 to the adjacent beam 11′. End 13 in this orientation of member 10 employs a U-shaped horizontal portion which is formed from an initially rectangular shape by first making two longitudinal cuts along lines 15 and 16 which divide the rectangular end 13 into three substantially equal longitudinally extending parts including outside legs 17 and 18 and a center leg 19. The center tab or leg 19 is then bent downward at its base along a right-angle bend line 21. Legs 17 and 18 form the sides of the U-shaped horizontal portion of leg 13 with leg 19 extending vertically downwardly from the inside of the base of the U-shaped configuration. Each of the legs 17 and 18 may be provided with a hole 22 for using in nailing the brace to beams 11, 11′ or a pointed knock-out protrusion 23 as shown in leg 17.

Protrusion 23 is formed by piercing along two lines which converge at one end to form a point 24. The pointed protrusion thus formed is buckled upwardly along a lateral bend 24′ at its center so that its point 24 extends in a generally downward direction. When end 13 of brace 10 is placed over the surface of a beam 11 or 11′ as shown in FIG. 1, the protrusion 23 may be struck by a hammer to drive the point 24 into the beam. An initial securing of end 13 to beam 11 is thus achieved. A nail may then be driven through hole 22 into the beam to provide a more secure attachment. Optional constructions may utilize holes 22 in both legs 17 and 18 or protrusions 23 may be provided in one or both of the legs.

Arm 12 is strengthened against bending or buckling by incorporation of a suitable bend, distortion or groove longitudinal of its length such as depression 25 which produces a U-shaped cross-sectional form as shown in FIG. 2A. Alternatively, the depression may have a V-shaped or right-angled cross-section 25′ as shown in FIG. 2B, or a more complex cross-section 25″ may be utilized as shown in FIG. 2C. Cross-section 25″ has a central semi-circular portion 26 with flanges 27 extending horizontally outward from each side.

In the utilization of member 10 in the construction of a building, one the beams such as beam 11 is installed first. The second beam 11′ is then positioned parallel to beam 11 at slightly more than the desired lateral distance therefrom. Beam 11 now has one vertical face 28 facing an opposing vertical face 29 of beam 11′. The exact positioning of beam 11′ is next achieved as follows: Member 10 is first placed across beams 11 and 11′ in perpendicular relationship therewith, and in a manner such that legs 17 and 18 of end 13 and resting on the top surface of beam 11, and legs 17 and 18 of end 14 are resting on the top surface of beam 11′. Beam 11′ is then moved toward beam 11 until leg 19 of end 13 is forced against face 28 of beam 11 and leg 19 of end 14 is forced against face 29 of beam 11′. Protrustions 23 may then be driven into beams 11 and 11′ and nails may be driven through the holes 22. The nails may be driven at a later time if desired to permit a more efficient use of time.

Any extra length of the legs 17 and 18 extending over the outside edges of the beam or joist may be bent down against the vertical side of the beam. Although theis feature is not shown in the drawing, the technique is well known in the trade.

As evident from FIG. 1, the members 10 may be disposed in rows between the beams or joists or may be installed in any other suitable manner as required such as in a staggered relationship. since the ends 13 and 14 are formed of thin material they ensure that there will be no appreciable interference with the leveling of an overlying surface such as flooring, ceiling and walls. Equally important in the structure of FIG. 1 is the characteristic that the perpendicular legs 19 lie closely adjacent the faces 28 and 29 of the beams 11 and 11′ so that when the members 10 are placed between the beams and nailed in place they not only hold one beam relative to the adjacent one at just the right distance apart but the legs 19 hold and keep them from laterally twisting and warping.

In a second embodiment of the invention as disclosed in FIGS. 3 and 4 a one-piece bridging member 30 is formed from a piece of angle iron of the variety commonly available in various dimensions including sizes such as three-quarter or one inch angle iron.

A one-inch angle iron, for example, may be formed by bending a two-inch wide strip of iron along its longitudinal cenerline at a right-angle to produce two perpendicular faces, each one inch wide. The thickness of the original strip might typically be approximately one-eighth inch. Materials of other types might also be economically useful in the application. Aluminum can readily be extruded to the same shape and its corrosion resistance further enhances its desirability for this application where hostile environmental conditions are encountered.

The formation of member 30 from a piece of angle-iron is most readily described with reference to FIG. 4 which shows the central arm 31 in the original form of a length of angle-iron having perpendicular faces 32 and 33 which meet along a longitudinal bend line 34. A fastening end 35 is formed by first cutting a short distance into the end of the piece of angle-iron along line 34 and then bending the separated end portion of face 33 upward or inward to form a perpendicularly-extending nailing tab 36. The portion of face 32 from which tab 36 has been separated forms a longitudinally-extending nailing tab 37. Nailing holes 38 and 39 are provided in tabs 36 and 37, respectively. At the other end of member 30 a fastening end 41 is provided which is identical to end 35 and which also has a longitudinally extending nailing tab 37 and a perpendicularly extending nailing tab 36.

The use of member 30 for all practical purposes is the same as for member 10 of FIG. 1. As shown in FIG. 3, member 30 is placed perpendicularly across adjacent parallel beams 11 and 11′ with tab 37 of end 35 resting on the top surface of beam 11 and with tab 37 of end 41 resting on the top surface of beam 11′. The perpendicularly extending tabs 36 of ends 35 and 41 bear against the opposing vertical surfaces of beams 11 and 11′ providing the desired spacing and resistance against bending and warping. The ends 35 and 41 are secured to the beams 11 and 11′ by nails 42 which are passed through the holes 38 and 39 and driven into the beams 11 and 11′.

In another embodiment of the invention as disclosed in FIG. 5 a bridging member 45 is formed from a flat strip of steel or other suitable material. A fastening end 46 is formed by first introducing two cuts 47 and 48 extending longitudinally of the bridging member inwardly from the end of the strip. Cut 47 separates from the main body of the original flat strip a first outlet leg 49 and cut 48 separates a second outer leg 51 on the opposite side of the strip. Cut 48 and leg 51 are shorter by an amount equal to the width of beam 11 than cut 47 and 49. Legs 49 and 51 are then bent perpendicularly downward at the terminations of the cuts 47 and 48. An unbent center portion 52 of the original flat strip remains between legs 49 and 51. A nailing hole 53 is provided in portion 52 at a centered position midway between the bending lines or bases 54 and 55 of legs 49 and 51. As in the case of the other embodiments of the invention, member 45 extends perpendicularly between adjacent parallel beams 11, 11'. As shown, leg 49 extends downward along the inside vertical surface 56 of the beam 11 and leg 51 extends downward along the outside vertical surface of beam 11. The two legs 49 and 51 thus securely grip the opposite vertical faces of a beam 11 as the flat unbent end portion of member 45 rests against the top surface of the beam. A nail 58 passing through hole 53 and driven into beam 11 completes the attachment of end 46 to beam 11. The legs 49 and 51 assure the accurate positioning of the successively installed beams 11, 11' and resist any tendancy for beams 11, 11' to tip or warp under load or other stresses.

Another variation in the form of the fastening end 13 or 14 of FIG. 1 is shown in FIG. 6 where a fastening end 60 is formed from an initially flat and rectangular end piece of a bridging member such as bridging member 10. A centered rectangle is first defined within the rectangular end piece, the rectangle having two sides 61 and 62 which run longitudinally with the length of the bridging member and two sides 63 and 64 which form the outer and inner ends of the rectangle. Sides 61, 62 and 63 are then pierced or cut and the center of the rectangle is bent perpendicularly downwardly along side 64 to form a first leg 65. The end of the original rectangular end piece is then bent perpendicularly downward along a line 66 which is coincident with side 63 to form a second leg 67. As in the case of the embodiment of FIG. 5, the legs 65 and 67 grip the opposite vertical surfaces of the beam 11.

FIG. 7 shows yet another fastening end 70 which is similar to end 60 of FIG. 6 and also to end 13 or 14 of FIG. 1. End 70 has a perpendicularly extending center leg 71 which corresponds to leg 19 of end 13, and it has two outside legs 72 and 73 which correspond, respectively, to legs 17 and 18 of end 13. The ends of legs 72 and 73, however, are bent perpendicularly downward along a line 74 which is parallel to the bending line 75 of leg 71 and which is spaced outward from line 75 a distance equal to the width of beam 11 so that as shown in FIG. 8, beam 11 is confined between the leg 71 and the perpendicularly downward extending ends of legs 72 and 73.

Holes for nailing may be provided at appropriate locations in the ends of legs 72 and 73 as in the case of the other embodiments of the invention.

A simple and inexpensive bridging member is thus provided in accordance with the stated objects of the invention and although but a few embodiments of the invention have been illustrated and described, it will be apparent to those skilled in the art that various changes and modifications may be made therein without departing from the spirit of the invention or from the scope of the appended claims.

What is claimed is:

1. An integral bridging element for interconnecting spaced substantially parallelly arranged longitudinal structural members such as joists, roof rafters and studding comprising:

an elongated thin, flat, rigid strip, a part of each of the opposite ends of said strip being bent into a plane normal to the plane of said ends and at a distance spaced from the associated end of said strip to form abutment flanges substantially parallel to each other spaced apart a distance equal to the desired distance between adjacent structural members, the portion of said strip between said ends being bent longitudinally thereof to form a reinforced web, means formed in each of said ends for use in fastening the bridging element to the associated structural members, said part of each of the opposite ends of said strip comprising a tab formed by at least one cut extending into and through the end of said strip longitudinally thereof and through a predetermined distance, and said tab being normal to the surface of said end to provide the abutment flange.

2. The integral bridging element set forth in claim 1 wherein:

the portion of said strip between said ends is grooved to form a reinforced web.

3. The integral bridging element set forth in claim 1 wherein:

each end of said strip is bent in the same direction as said abutment flanges to form additional flanges for lying against other sides of said structural members.

4. The integral bridging element set forth in claim 1 wherein:

said means comprises a hole for receiving a nail.

5. The integral bridging element set forth in claim 1 wherein:

said means comprises a knockout protrusion deformed to buckle outwardly of the surface of said end to form a piercing protrusion which when struck by a hammer will be driven through the hole in said end formed by itself to penetrate the surface of the associated structural member.

6. An integral bridging element for interconnecting spaced substantially parallelly arranged longitudinal structural members such as joists, roof rafters and studding comprising:

an elongated thin, flat rigid strip, a part of each of the opposite ends of said strip being bent into a plane normal to the plane of said ends and at a distance spaced from the associated end of said strip to form abutment flanges substantially parallel to each other spaced apart a distance equal to the desired distance between adjacent structural members, the portion of said strip between said ends being bent longitudinally thereof to form a reinforced web, means formed in each of said ends for use in fastening the bridging element to the associated structural member, said part of each of the opposite ends of said strip comprising a tab formed by two spaced cuts extending into and through the end of said strip longitudinally thereof a predetermined distance, and said tab being bent normal to the surface of said end to provide the abutment flange.

7. The integral bridging element set forth in claim 6 wherein:

the ends of said strip excluding each of said part being bent in the same direction as said part to form additional flanges for lying adjacent other sides of said structural members.

8. An integral bridging element for interconnecting spaced substantially parallelly arranged longitudinal structural members such as joists, roof rafters and studding comprising:

an elongated thin, flat, rigid strip, a part of each of the opposite ends of said strip being bent into a plane normal to the plane of said ends and at a distance spaced from the associated end of said strip to form abutment flanges substantially parallel to each other spaced apart a distance equal to the desired distance between adjacent structural members, the portion of said strip between said ends being bent longitudinally thereof to form a reinforced web, means formed in each of said ends for use in fastening the bridging element to the associated structural members, said part of each of the opposite ends of said strip comprising a tab formed along one side of the end of said strip, and a second part formed along each of said ends, said second part being bent normal to the surface of said end to provide a second flange for engaging the surface of the associated structural member opposite to the surface of the structural member engaged by the abutment flange formed at said end.

9. The integral bridging element set forth in claim 8 wherein:

said second part is formed along a different side of each of said ends.

* * * * *

UNITED STATES PATENT OFFICE

CERTIFICATE OF CORRECTION

Patent No. 4,246,736 Dated January 27, 1981

Inventor(s) Paul J. Kovar and Marvin D. Southerlan

It is certified that error appears in the above-identified patent and that said Letters Patent are hereby corrected as shown below:

Column 6, line 16, after "being" insert ---bent---.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*